US012298111B2

(12) United States Patent
Taylor

(10) Patent No.: US 12,298,111 B2
(45) Date of Patent: May 13, 2025

(54) BALLISTIC SHIELD

(71) Applicant: Blue Ridge Armor LLC, Spindale, NC (US)

(72) Inventor: Dale Taylor, Bostick, NC (US)

(73) Assignee: Blue Ridge Armor LLC, Spindale, NC (US)

( * ) Notice: Subject to any disclaimer, the term of this patent is extended or adjusted under 35 U.S.C. 154(b) by 0 days.

(21) Appl. No.: 18/471,064

(22) Filed: Sep. 20, 2023

(65) Prior Publication Data

US 2024/0093974 A1 Mar. 21, 2024

Related U.S. Application Data

(60) Provisional application No. 63/376,368, filed on Sep. 20, 2022.

(51) Int. Cl.

| | |
|---|---|
| ***F41H 5/08*** | (2006.01) |
| ***F41H 5/013*** | (2006.01) |
| ***F41H 5/04*** | (2006.01) |

(52) U.S. Cl.

CPC ..... *F41H 5/08* (2013.01); *F41H 5/013* (2013.01); *F41H 5/0407* (2013.01)

(58) Field of Classification Search

CPC ..... F42H 5/06; F42H 5/08; F42H 5/0407

See application file for complete search history.

(56) References Cited

U.S. PATENT DOCUMENTS

| | | | | |
|---|---|---|---|---|
| 2,316,055 | A * | 4/1943 | Davey | F41H 5/08 2/2.5 |
| 4,674,394 | A * | 6/1987 | Martino | F41H 5/08 2/2.5 |
| 5,377,577 | A | 1/1995 | Bounkong et al. | |
| 6,000,347 | A * | 12/1999 | Madden, Jr. | A45C 15/00 109/22 |
| 6,807,890 | B1 * | 10/2004 | Fuqua | F41H 5/08 89/36.02 |
| 7,302,880 | B1 * | 12/2007 | Elasic | F41H 13/0087 89/36.01 |
| 7,716,748 | B2 * | 5/2010 | Dovner | F41C 33/0209 89/36.01 |
| 8,015,910 | B1 * | 9/2011 | Fuqua | F41H 5/14 89/36.01 |
| 8,210,088 | B1 * | 7/2012 | Keyfauver | F41H 5/08 89/918 |
| 8,267,003 | B1 * | 9/2012 | Lou | F41H 5/013 89/929 |
| 8,276,498 | B1 * | 10/2012 | Hannibal | F41H 5/08 89/926 |
| 8,584,571 | B2 | 11/2013 | Armellino, Jr. | |

(Continued)

*Primary Examiner* — Joshua E Freeman

(74) *Attorney, Agent, or Firm* — GREENBERG TRAURIG, LLP

(57) ABSTRACT

A ballistic shield including: a shield body with a front surface and a back surface opposite the front surface, a viewport disposed in an opening of the shield body, where the viewport includes a front surface and a back surface opposite the front surface of the viewport; a front bezel covering at least a portion of the front surface of the shield body and a front surface of the viewport; a gasket covering at least a portion of the back surface of the shield body and a back surface of the viewport; and a back bezel covering at least a portion of the gasket.

16 Claims, 5 Drawing Sheets

(56) References Cited

U.S. PATENT DOCUMENTS

| | | | | |
|---|---|---|---|---|
| 8,671,820 | B1 * | 3/2014 | Keyfauver | F41H 5/08 89/918 |
| 9,347,747 | B2 * | 5/2016 | Mickiewicz | F41H 5/26 |
| 10,180,308 | B2 * | 1/2019 | Lang | F41H 5/08 |
| 10,288,387 | B1 * | 5/2019 | Marcum | F41H 5/08 |
| 10,584,943 | B2 * | 3/2020 | Armellino, Jr. | F41H 5/08 |
| 10,996,027 | B2 | 5/2021 | Gonzalez | |
| 11,162,764 | B1 * | 11/2021 | Britcher | F41B 15/022 |
| 11,340,044 | B1 * | 5/2022 | Fuerte | A62C 25/00 |
| 11,486,679 | B1 * | 11/2022 | Adelmann | G08B 7/06 |
| 11,519,699 | B1 * | 12/2022 | Kissinger | F21V 23/04 |
| 2007/0283477 | A1 * | 12/2007 | Dovner | F41H 9/10 2/2.5 |
| 2010/0101404 | A1 * | 4/2010 | Lorenzo | E04H 9/10 89/36.04 |
| 2011/0005380 | A1 | 1/2011 | Hogan | |
| 2014/0233235 | A1 * | 8/2014 | Micarelli | F41H 5/08 362/253 |
| 2014/0238225 | A1 * | 8/2014 | Mickiewicz | F41H 5/26 89/36.07 |
| 2015/0233679 | A1 * | 8/2015 | Seabrook | F41A 27/10 89/36.07 |
| 2016/0290770 | A1 * | 10/2016 | Martinez | F41H 5/08 |
| 2017/0038179 | A1 * | 2/2017 | Martin | F16M 11/28 |
| 2018/0058819 | A1 * | 3/2018 | Mickiewicz | F41H 5/18 |
| 2018/0120064 | A1 * | 5/2018 | Lang | F41H 5/08 |
| 2018/0202771 | A1 * | 7/2018 | Armellino, Jr. | F41H 5/08 |
| 2019/0101363 | A1 * | 4/2019 | Stewart | F41H 7/00 |
| 2019/0390941 | A1 * | 12/2019 | Beck | F41H 5/04 |
| 2020/0025525 | A1 * | 1/2020 | Spransy | F41H 5/08 |
| 2022/0276025 | A1 * | 9/2022 | Jackson, Sr. | F16M 13/04 |

* cited by examiner

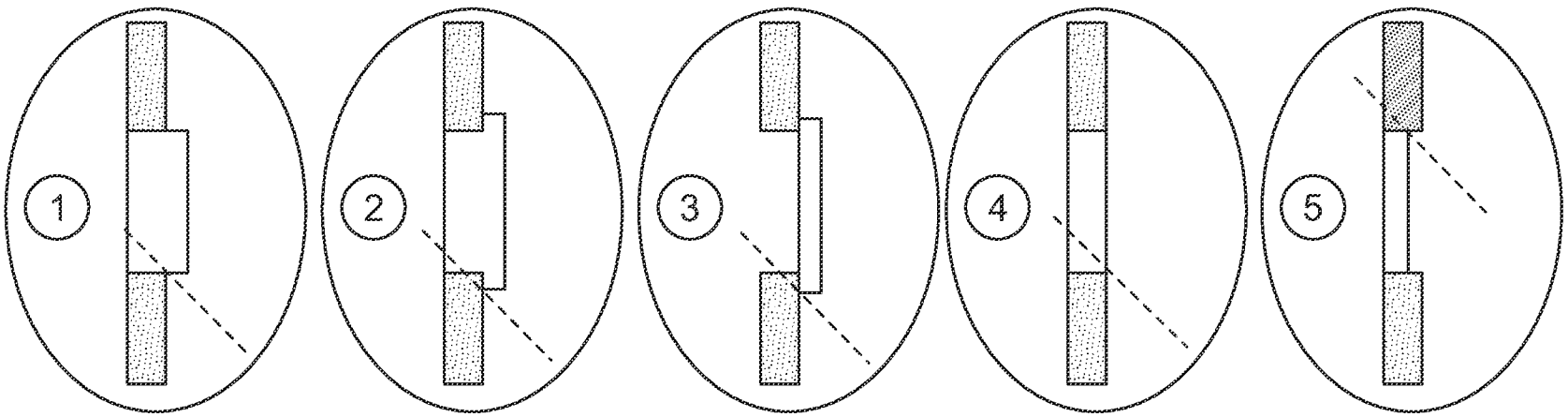
FIG. 6A
FIG. 6B
FIG. 6C
FIG. 6D
FIG. 6E
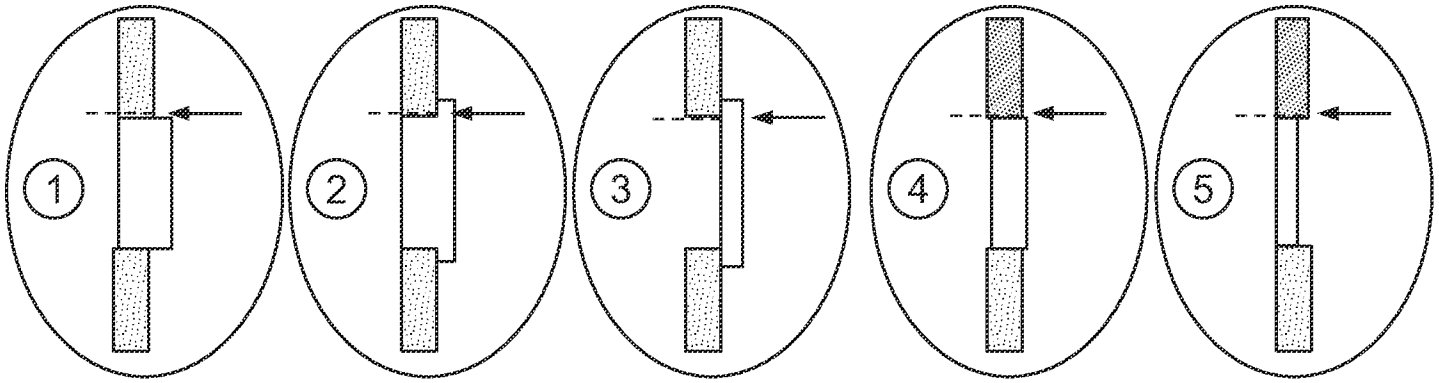

BALLISTIC SHIELD

CROSS-REFERENCE TO RELATED APPLICATIONS

This application claims the benefit of priority to U.S. Provisional Patent Application Ser. No. 63/376,368, filed Sep. 20, 2022, entitled "Ballistic Shield," the contents of which is incorporated herein by reference in its entirety.

FIELD OF THE INVENTION

The present invention relates to a ballistic shield, and, more particularly, to a portable ballistic shield.

BACKGROUND OF THE INVENTION

A ballistic shield (which may also be referred to as a tactical shield) may be carried by police, paramilitary, and/or armed forces. A ballistic shield is generally designed to stop or deflect a bullet fired at the shield or carrier of the shield.

SUMMARY OF THE INVENTION

The Claims, rather than the Summary, define covered embodiments of the present invention. The Summary is a high-level overview of various aspects of the invention, and introduces some concepts that are further described in the Detailed Description below. The Summary is not intended to identify key or essential features of the claimed subject matter, and also is not intended to be used in isolation to determine the scope of the claimed subject matter. Instead, the claimed subject matter should be understood by reference to appropriate portions of the Specification and drawings, as well as to each claim.

In some embodiments, the present invention provides a ballistic shield, comprising: a shield body including a front surface and a back surface opposite the front surface, a viewport disposed in an opening of the shield body, wherein the viewport includes a front surface and a back surface opposite the front surface of the viewport; a front bezel covering at least a portion of the front surface of the shield body and a front surface of the viewport; a gasket covering at least a portion of the back surface of the shield body and a back surface of the viewport; and a back bezel covering at least a portion of the gasket.

In some embodiments, the shield body comprises a composite material, a metal material, or a combination thereof.

In some embodiments, the shield body meets a threat level IIIA handgun, III rifle, or level IV piercing rifle rating.

In some embodiments, the shield further comprises a lighting system, wherein the lighting system is disposed on the front surface of the shield body.

In some embodiments, the shield body is curved.

In some embodiments, the shield further comprises a plurality of washer assemblies connecting the front bezel to the shield body.

In some embodiments, the plurality of washer assemblies connect the back bezel to the shield body.

In some embodiments, each of the plurality of washer assemblies comprises: a ballistic cone; and a shank, wherein the ballistic cone is disposed on an end of the shank, wherein the ballistic cone is configured to move along the shank in response to application of a force to the ballistic cone.

In some embodiments, the shield further comprises a first plurality of washer assemblies, wherein each of the first plurality of washer assemblies comprises: a ballistic cone; a shank; and a spring, wherein the ballistic cone is disposed on an end of the shank, wherein the spring is disposed on the shank, wherein the ballistic cone is configured to move along the shank in response to application of a force to the ballistic cone.

In some embodiments, the shield further comprises a lighting system; and a second plurality of washer assemblies connecting the lighting system to the front surface of the shield body.

In some embodiments, the present invention provides a ballistic shield, comprising: a shield body including a front surface and a back surface opposite the front surface, wherein the shield body includes an opening extending between the front surface and the back surface; a viewport disposed in the opening of the shield body, wherein the viewport includes a front surface and a back surface opposite the front surface of the viewport, wherein the front surface of the viewport is adjacent the front surface of the shield body, wherein the back surface of the viewport is adjacent the back surface of the shield body; a handle connected to the back surface of the shield body; a front bezel covering at least a portion of the front surface of the shield body and a front surface of the viewport; a gasket covering at least a portion of the back surface of the shield body and a back surface of the viewport; and a back bezel covering at least a portion of the gasket.

BRIEF DESCRIPTION OF THE DRAWINGS

Various embodiments of the present disclosure may be further explained with reference to the attached drawings, wherein like structures are referred to by like numerals throughout the several views. The drawings shown are not necessarily to scale, with emphasis instead generally being placed upon illustrating the principles of the present disclosure. Therefore, specific structural and functional details disclosed herein are not to be interpreted as limiting, but merely as a representative basis for teaching one skilled in the art to variously employ one or more illustrative embodiments.

FIGS. 6A-6E are cross sections of viewports, in accordance with embodiments of the invention.

DETAILED DESCRIPTION

Various detailed embodiments of the present disclosure, taken in conjunction with the accompanying figures, are disclosed herein; however, it is to be understood that the disclosed embodiments are merely illustrative. In addition, each of the examples given in connection with the various embodiments of the present disclosure is intended to be illustrative, and not restrictive.

Throughout the specification, the following terms take the meanings explicitly associated herein, unless the context clearly dictates otherwise. The phrases "in one embodiment" and "in some embodiments" as used herein do not necessarily refer to the same embodiment(s), though they may. Furthermore, the phrases "in another embodiment" and "in some other embodiments" as used herein do not necessarily refer to a different embodiment, although they may. Thus, as described below, various embodiments may be readily combined, without departing from the scope or spirit of the present disclosure.

In addition, the term "based on" is not exclusive and allows for being based on additional factors not described, unless the context clearly dictates otherwise. In addition, throughout the specification, the meaning of "a," "an," and "the" include plural references. The meaning of "in" includes "in" and "on."

As used herein, the terms "and" and "or" may be used interchangeably to refer to a set of items in both the conjunctive and disjunctive in order to encompass the full description of combinations and alternatives of the items. By way of example, a set of items may be listed with the disjunctive "or," or with the conjunction "and." In either case, the set is to be interpreted as meaning each of the items singularly as alternatives, as well as any combination of the listed items.

Figure 1:
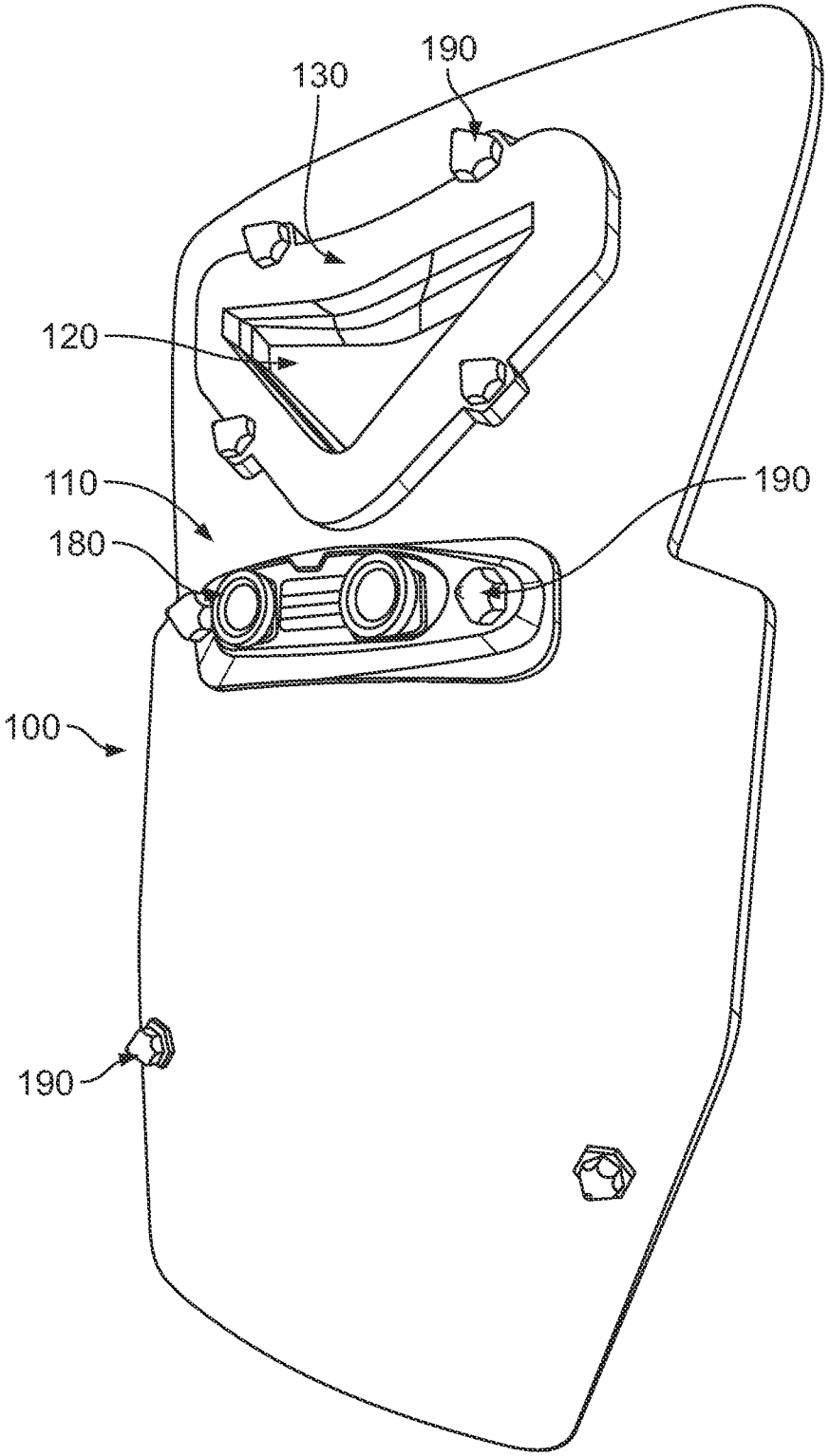
FIG. 1 is an isometric front view of a ballistic shield, in accordance with embodiments of the invention.
Figure 2:
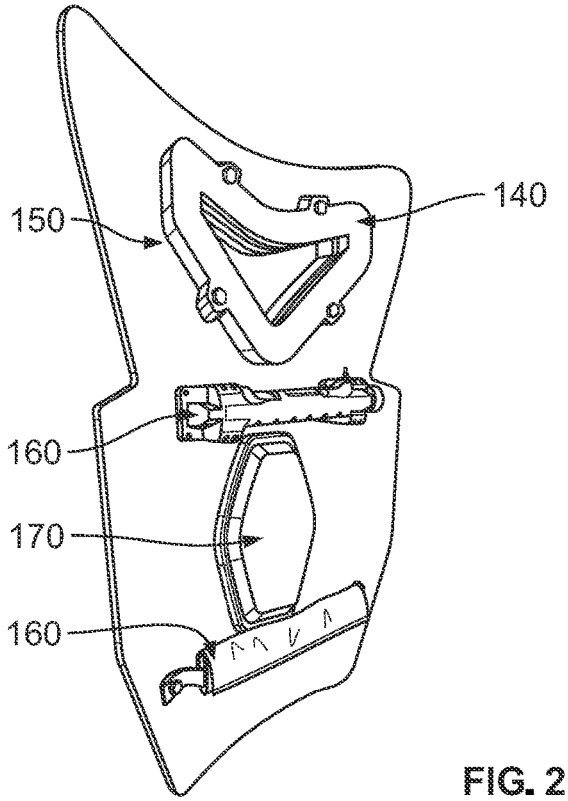
FIG. 2 is an isometric back view of a ballistic shield, in accordance with embodiments of the invention.
Figure 3:
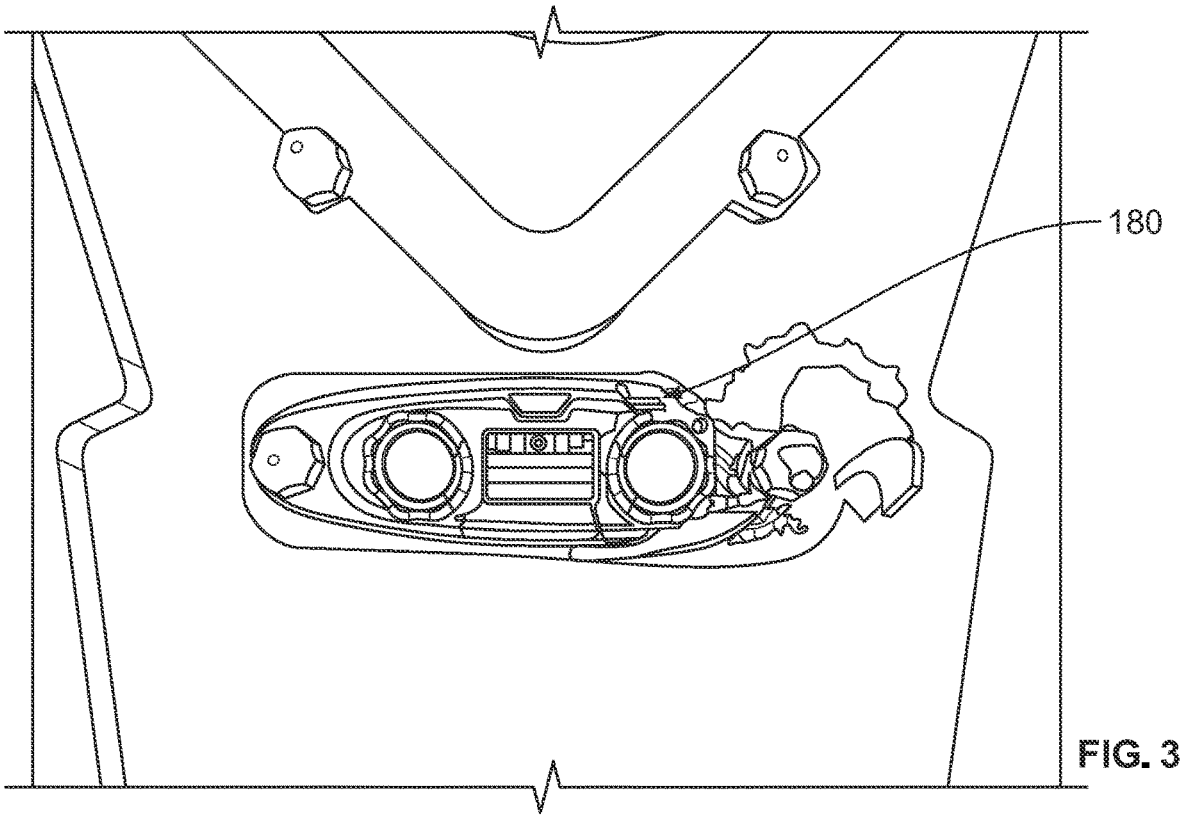
FIG. 3 is a detail view of a portion of FIG. 1.
Figure 4:
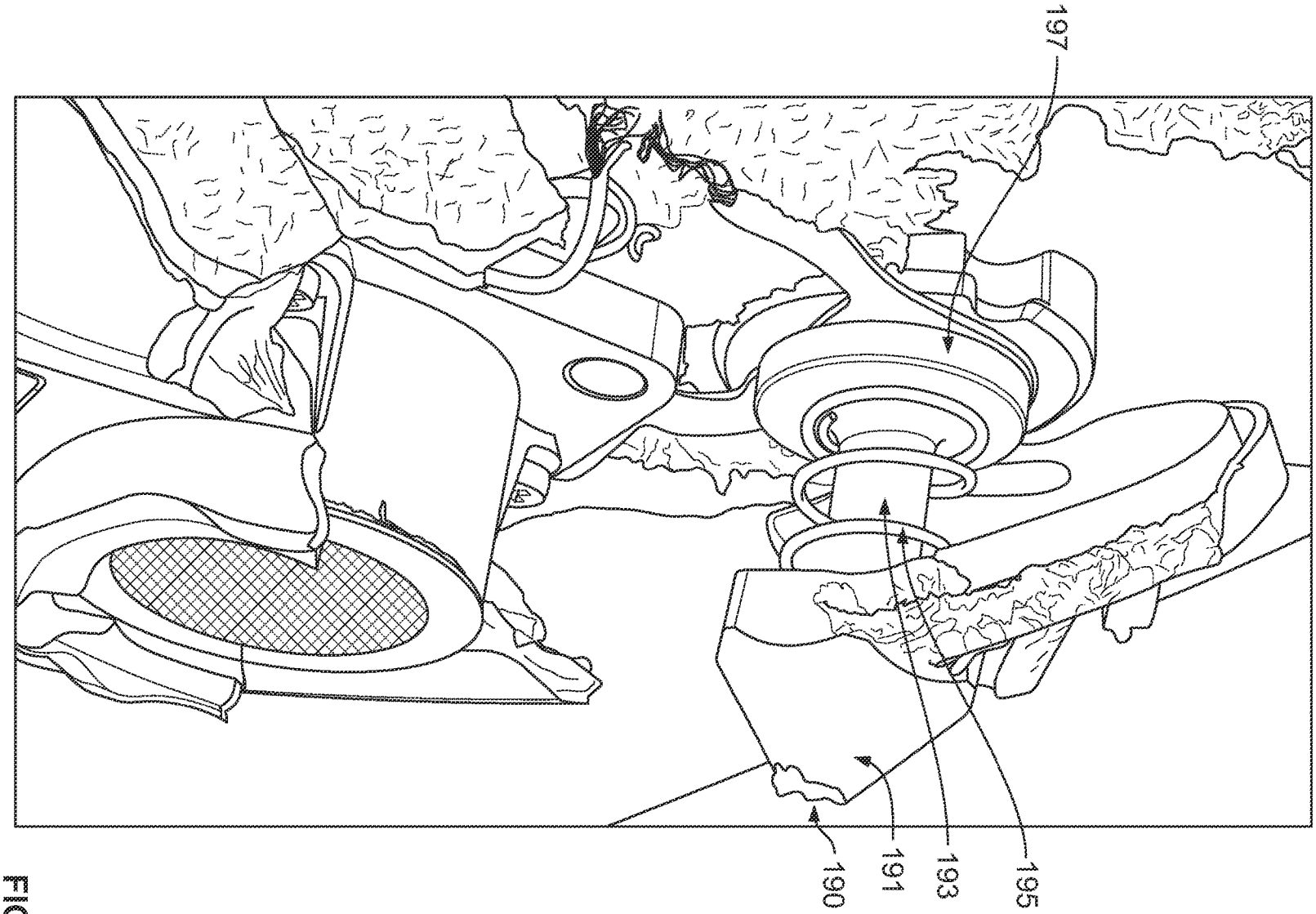
FIG. 4 is a detail view of a portion of FIG. 1 and FIG. 3.
Figure 5:
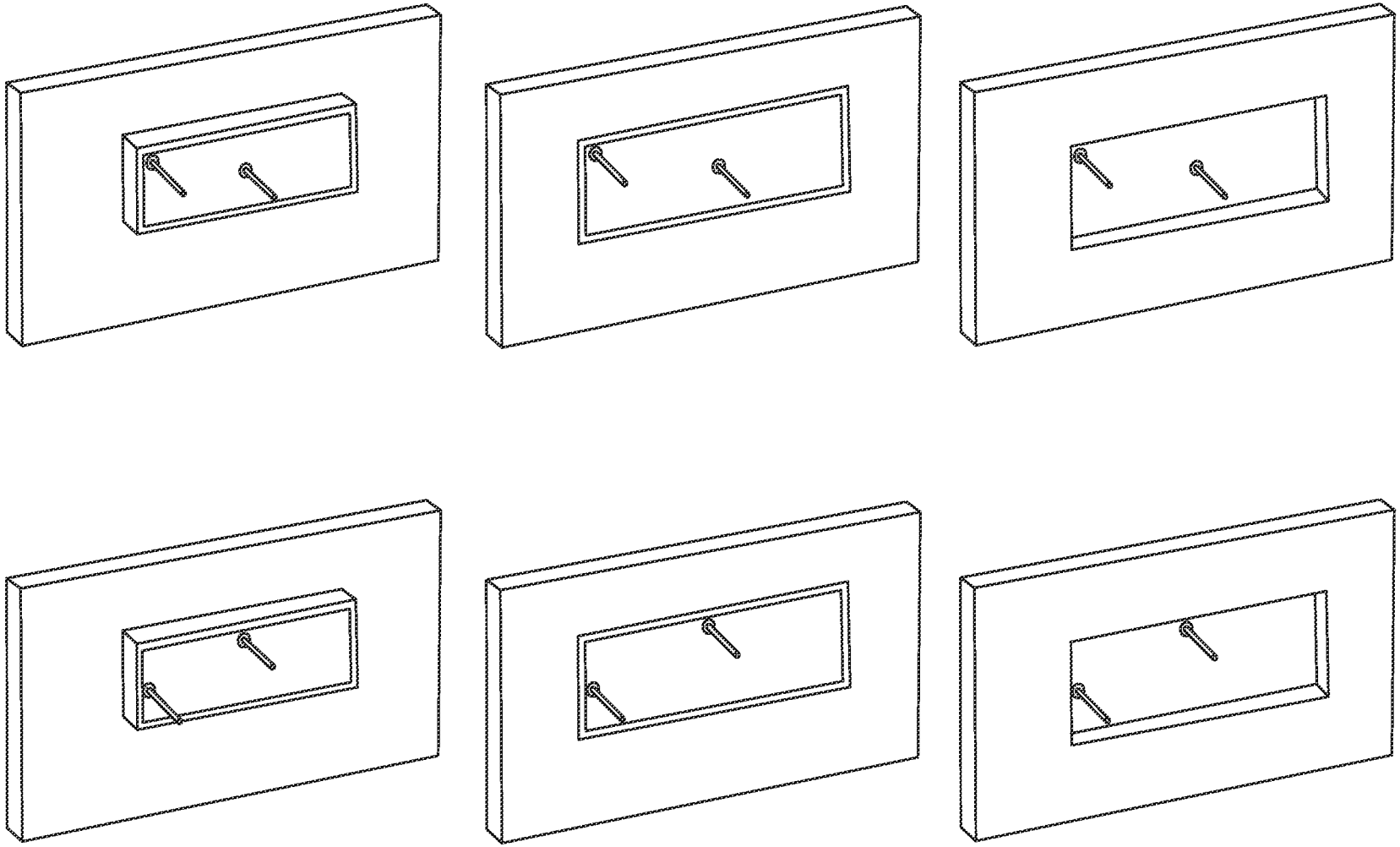
FIG. 5 is a detail view of viewports, in accordance with embodiments of the invention.

With reference to FIGS. 1-6E, the ballistic shield 100 may include a shield body 110. In some embodiments, the shield body 110 may be a curved shield body, a flat shield body, an angled shield body, another shape shield body, and/or a combination of these shapes and/or other shapes. In some embodiments, the shield body 110 may be manufactured from one or more of a composite material, a metal material, such as steel, a different material, and/or a combination of materials, such as a combination of a composite material and a metal material. In some embodiments, the shield body 110 may be manufactured from a material sufficient to meet a threat level IIIA handgun, III rifle, or level IV piercing rifle rating. In some embodiments, the shield body 110 may be manufactured from a material sufficient to meet a threat level lower than IIIA handgun rating, or higher than a level IV piercing rifle rating.

In some embodiments, the shield 100 may include a composite viewport 120. In some embodiments, the composite viewport 120 may be sized, shaped, positioned, and/or otherwise configured to provide a view through the shield 100, such as by a person holding or behind the shield 100. In some embodiments, the viewport 120 may be disposed in an opening in the shield body 110, which extends between a front surface of the shield body and a back surface of the shield body which is opposite the front surface. In some embodiments, the viewport 120 may be sized, shaped, positioned, and/or otherwise configured to provide a wider field of view than a rectangular viewport, and to enhance lower peripheral vision giving a clear forward view of obstacles and trip hazards. In some embodiments, the viewport 120 may be a rectangular viewport. In some embodiments, the viewport 120 may be formed from a material that is clear. In some embodiments, the viewport 120 may be formed from a material that is transparent. In some embodiments, the viewport 120 may be formed from a material that is translucent. In some embodiments, the material is an acrylic material. In some embodiments, the material is a plexiglass material. In some embodiments, the material is a combination of the foregoing materials. In some embodiments, the viewport 120 includes a front surface and a back surface opposite the front surface. In some embodiments, the front surface of the viewport 120 is adjacent or closer to the front surface of the shield body 110. In some embodiments, the back surface of the viewport 120 is adjacent or closer to the back surface of the shield body 110.

In some embodiments, the shield body 110 may be sized, shaped, and/or otherwise configured, such as with a bottom tapered portion, to facilitate mobility in a narrow passageway. In some embodiments, the shield body 110 may be sized, shaped, and/or otherwise configured to facilitate carrying by a single person.

In some embodiments, the shield 100 may include a front bezel 130 on the front or front surface of shield body 110 and surrounding the viewport 120. In some embodiments, the front bezel 130 may be manufactured from a material sufficient to meet the same threat level as, or a greater threat level than, the threat level met by the shield body 110. In some embodiments, the front bezel 130 may cover at least a portion of the front surface of shield body 110, and/or the viewport 120.

In some embodiments, the front bezel 130 may be sized, shaped, positioned, and/or otherwise configured to cover any seam in the shield 100, such as any seam in the shield body 110.

In some embodiments, the front bezel 130 may be manufactured from a same material (such as a composite material and/or a metal material) as the shield body 110, or a different material. In some embodiments, the front bezel 130 may be attached to the shield body 110 by one or more of an adhesive (such as a liquid or tape adhesive), or a bolt, or combinations thereof.

In some embodiments, the shield 100 may include a back bezel 140 on the back or back surface of shield body 110 and surrounding the viewport 120. In some embodiment, the back bezel 140 may be manufactured from a material sufficient to meet the same threat level as, or a greater threat level than, the threat level met by the shield body 110 and/or the front bezel 130. In some embodiments, the back bezel 140 may cover any seams in the shield 100. In some embodiments, the back bezel 140 may cover at least a portion of the back surface of shield body 110, and/or the viewport 120.

In some embodiments, the back bezel 140 may be sized, shaped, positioned, and/or otherwise configured to cover any seam in the shield 100, such as any seam in the shield body 110.

In some embodiments, the back bezel 140 may be manufactured from a same material (such as a composite material and/or metal material) as the shield body 110 and/or the front bezel 130, or a different material. In some embodiments, the back bezel 140 may be attached to the shield body 110 by one or more of an adhesive (such as a liquid or tape adhesive), or a bolt, or combinations thereof. By using both the front bezel 130 and the back bezel 140, the shield 100 may provide twice the ballistic protection around the viewport 120 as compared to a ballistic shield that uses only one bezel around the viewport.

In some embodiments, the shield 100 may include a composite gasket 150. In some embodiments, the composite gasket 150 may be a ballistic-rated composite gasket. In some embodiments, the composite gasket 150 may be manufactured from a material sufficient to meet the same threat level as, or a greater threat level than, any or all of the shield body 110, the front bezel 130, and/or the back bezel 140. In some embodiments, the composite gasket 150 may be placed on the front surface of the shield body 110, and/or on the back surface of the shield body 110. In some embodiments, the composite gasket 150 may be placed either or both of: between the back of the shield body 110 and the viewport 120; and/or between the viewport 120 and the back bezel 140. In some embodiments, the composite gasket 150 may surround any gaps, spaces, or seams in front of, between, or behind one or more of the bezels and/or the viewport. In some embodiments, the composite gasket 150 may be placed on the front surface of the shield body 110, such as between the front surface of the shield body 110 and the front bezel 130.

In some embodiments, one or more of, or all of, the viewport 120, the front bezel 130, and/or the back bezel 140 may be recessed within, or may be installed on one or more surfaces of, the shield body 110.

As shown in the figures, in some embodiments, the shield 100 may include one or more handles 160 on the back surface of the shield body 110. In some embodiments, the handles 160 may be either rigid or flexible. In some embodiments, the handles 160 may be manufactured from one or more, or all, of a carbon fiber, fiberglass, a composite, a molded and/or injected plastic, or a combination of carbon fiber, fiberglass, and/or molded and/or injected plastic. In some embodiments, the handle 160 may be made of metal such as but not limited to steel, stainless steel, aluminum, or a combination thereof and/or metallic hybrids such as aluminum/magnesium.

In some embodiments, the shield 100 may include a panel 170. The panel 170 may be sized, located, or otherwise configured to provide additional protection to the torso and/or other part of the body of the person holding the shield 100. In some embodiments, the panel 170 may be manufactured from a material sufficient to meet a threat level IIIA handgun, III rifle, or level IV piercing rifle rating. In some embodiments, the panel 170 may be manufactured from a material sufficient to meet a threat level lower than IIIA handgun rating, or higher than a level IV piercing rifle rating.

The shield 100 may include an integrated lighting system 180. The lighting system 180 may be ballistic rated. In some embodiments, the lighting system 180 may be disposed on the front of the shield 100. In some embodiments, the lighting system 180 may be operable from behind the shield 100.

As shown in the figures, each of the front bezel 130 and the back bezel 140, the handles 160, and the lighting system 180 may be secured to the shield body 110 with washer assemblies 190. The washer assemblies 190 may be sized, shaped, positioned, and/or otherwise configured to absorb shock, such as that resulting from the washer assembly 190 being impacted by a bullet. The washer assemblies 190 may include a ballistic cone 191, which is movably disposed on an end of shank 193 in response to the application of a force or shock, with a spring 195 disposed between the ballistic cone 191 and an end 197 of shank 193. By this arrangement, the ballistic cone 191 may move along the shank 193, such that the washer assembly 190 may absorb some shock without breaking. The end 197 of the washer assembly 190 may be integrated into the shield body 110. In some embodiments, the shank 193 is connected to a bolt. In some embodiments, the bolt includes a bolt head. In some embodiments, the bolt head is behind the back surface of the shield body 110. In some embodiments, the bolt head contact the back surface of the shield body 110, and/or the back bezel 140.

In some embodiments, when washer assemblies 190 or other fasteners are used to attach components to the shield body 110, the components may be replaceable, such as in the field, if the component becomes damaged. For example, one or more, or all of, the front bezel 130 and the back bezel 140, the handles 160, may be replaceable by removing fasteners and/or washer assemblies 190. Further, the viewport 120 may be replaceable, such as by removing washer assemblies 190 or other fasteners if the viewport 120 becomes damaged, such as from the shield 100 being dropped, or something impacting the viewport 120.

FIGS. 6A-6E show various configurations and locations of the viewport 120 within the shield body 110. As shown, the viewport 120 may be disposed between the back surface of the shield body and protrude from the front of the shield body 110 as in FIG. 6A; may be disposed between the back surface of the shield body as well as protrude from and overlap the front of the shield body 110 as in FIG. 6B; may be disposed entirely on the front surface of the shield body 110 as in FIG. 6C; may be disposed entirely between the back surface and the front surface of the shield body 110 as in FIG. 6D; and may be recessed from the front surface as shown in FIG. 6E. The shield 100 may include other locations and arrangements of the viewport 120. Although not shown in these figures, any of the configurations shown in FIGS. 6A-6E may include one or both of the front bezel 130 and/or the back bezel 140, and/or the gasket 150.

Variations, modifications and alterations to embodiments of the present disclosure described above will make themselves apparent to those skilled in the art. All such variations, modifications, alterations and the like are intended to fall within the spirit and scope of the present disclosure, limited solely by the appended claims.

While several embodiments of the present disclosure have been described, it is understood that these embodiments are illustrative only, and not restrictive, and that many modifications may become apparent to those of ordinary skill in the art. For example, all dimensions discussed herein are provided as examples only, and are intended to be illustrative and not restrictive.

Any feature or element that is positively identified in this description may also be specifically excluded as a feature or element of an embodiment of the present as defined in the claims.

The disclosure described herein may be practiced in the absence of any element or elements, limitation or limitations, which is not specifically disclosed herein. Thus, for example, in each instance herein, any of the terms "comprising," "consisting essentially of" and "consisting of" may be replaced with either of the other two terms, without altering their respective meanings as defined herein. The terms and expressions which have been employed are used as terms of description and not of limitation, and there is no intention in the use of such terms and expressions of excluding any equivalents of the features shown and described or portions thereof, but it is recognized that various modifications are possible within the scope of the disclosure.

The invention claimed is:

1. A ballistic shield, comprising:

a shield body including a front surface and a back surface opposite the front surface;

a viewport disposed in an opening of the shield body, wherein the viewport includes a front surface and a back surface opposite the front surface of the viewport;

a front bezel covering at least a portion of the front surface of the shield body and a front surface of the viewport;

a gasket covering at least a portion of the back surface of the shield body and a back surface of the viewport;

a back bezel covering at least a portion of the gasket; and a plurality of washer assemblies, wherein each of the plurality of washer assemblies comprises:

a ballistic cone;

a shank; and
a spring,
wherein the ballistic cone is disposed on an end of the shank,
wherein the spring is disposed on the shank,
wherein the ballistic cone is configured to move along the shank in response to application of a force to the ballistic cone.

2. The ballistic shield of claim 1, wherein the shield body comprises a composite material, a metal material, or a combination thereof.

3. The ballistic shield of claim 1, wherein the shield body comprises a material sufficient to meet a threat level IIIA handgun, III rifle, or level IV piercing rifle rating.

4. The ballistic shield of claim 1, further comprising:
a lighting system,
wherein the lighting system is disposed on the front surface of the shield body.

5. The ballistic shield of claim 1, wherein the shield body is curved.

6. The ballistic shield of claim 1, wherein at least some of the
plurality of washer assemblies connect the front bezel to the shield body.

7. The ballistic shield of claim 1, wherein at least some of the plurality of washer assemblies connect the back bezel to the shield body.

8. The ballistic shield of claim 1, further comprising:
a lighting system,
wherein at least some of the plurality of washer assemblies connect the lighting system to the front surface of the shield body.

9. A ballistic shield, comprising:
a shield body including a front surface and a back surface opposite the front surface,
wherein the shield body includes an opening extending between the front surface and the back surface;
a viewport disposed in the opening of the shield body,
wherein the viewport includes a front surface and a back surface opposite the front surface of the viewport,
wherein the front surface of the viewport is adjacent the front surface of the shield body,
wherein the back surface of the viewport is adjacent the back surface of the shield body;
a handle connected to the back surface of the shield body;
a front bezel covering at least a portion of the front surface of the shield body and a front surface of the viewport;
a gasket covering at least a portion of the back surface of the shield body and a back surface of the viewport; and
a back bezel covering at least a portion of the gasket; and
a plurality of washer assemblies,
wherein each of the plurality of washer assemblies comprises:
a ballistic cone;
a shank; and
a spring,
wherein the ballistic cone is disposed on an end of the shank,
wherein the spring is disposed on the shank,
wherein the ballistic cone is configured to move along the shank in response to application of a force to the ballistic cone.

10. The ballistic shield of claim 9, wherein the shield body comprises a composite material, a metal material, or a combination thereof.

11. The ballistic shield of claim 9, wherein the shield body comprises a material sufficient to meet a threat level IIIA handgun, III rifle, or level IV piercing rifle rating.

12. The ballistic shield of claim 9, further comprising:
a lighting system,
wherein the lighting system is disposed on the front surface of the shield body.

13. The ballistic shield of claim 9, wherein the shield body is curved.

14. The ballistic shield of claim 9, wherein at least some of the plurality of washer assemblies connect the front bezel to the shield body.

15. The ballistic shield of claim 9, wherein at least some of the plurality of washer assemblies connect the back bezel to the shield body.

16. The ballistic shield of claim 9, further comprising:
a lighting system,
wherein at least some of the plurality of washer assemblies connect the lighting system to the front surface of the shield body.

* * * * *